US006918560B2

(12) United States Patent
Arai

(10) Patent No.: US 6,918,560 B2
(45) Date of Patent: Jul. 19, 2005

(54) WINDING APPARATUS AND FEEDING APPARATUS

(75) Inventor: Koji Arai, Kanuma (JP)

(73) Assignee: Sony Chemicals Corporation, Tokyo (JP)

( * ) Notice: Subject to any disclaimer, the term of this patent is extended or adjusted under 35 U.S.C. 154(b) by 35 days.

(21) Appl. No.: 10/642,739

(22) Filed: Aug. 19, 2003

(65) Prior Publication Data

US 2004/0050992 A1 Mar. 18, 2004

(30) Foreign Application Priority Data

Feb. 20, 2001 (JP) ..... 2001-043071
May 18, 2001 (JP) ..... 2001-149264

(51) Int. Cl.[7] ..... B65H 19/22; B65H 19/10

(52) U.S. Cl. ..... 242/533.7; 242/160.2; 242/531; 242/534; 242/559.3; 242/563

(58) Field of Search ..... 242/160.2, 167, 242/531, 534, 533.7, 534.2, 471, 559.3, 563, 563.2

(56) References Cited

U.S. PATENT DOCUMENTS 3,025,015 A * 3/1962 Mix ..... 242/613.2
3,836,090 A * 9/1974 Mix ..... 242/160.2
4,022,396 A * 5/1977 Manchester et al. ..... 242/160.2
4,133,491 A * 1/1979 Yamazaki et al. ..... 242/530.4
4,477,035 A * 10/1984 O'Connor ..... 242/471

FOREIGN PATENT DOCUMENTS

| | | | |
|---|---|---|---|
| JP | A 58-221674 | 12/1983 | |
| JP | 2-38247 | * 7/1990 | ..... 242/160.2 |
| JP | A 3-65371 | 3/1991 | |
| JP | A 4-338544 | 11/1992 | |
| JP | A 6-179554 | 6/1994 | |
| JP | A 8-119509 | 5/1996 | |
| JP | A 9-315628 | 12/1997 | |

* cited by examiner

*Primary Examiner*—John M. Jillions
(74) *Attorney, Agent, or Firm*—Oliff & Berridge, PLC

(57) ABSTRACT

A winding apparatus adaptable to longer films with minimum design changes in existing apparatus has a winding shaft 31 on which a reel member 50 capable of winding a given film at multiple stages can be mounted. The winding shaft 31 can be moved in the rotational and axial directions of the reel member 50. The winding apparatus 10 further has a driving mechanism 40 for giving power in the rotational and axial directions to the winding shaft 31.

5 Claims, 9 Drawing Sheets

WINDING APPARATUS AND FEEDING APPARATUS

FIELD OF THE INVENTION

The present invention relates to the technique of winding a long continuous film during the preparation process of an anisotropic conductive adhesive film or an insulating adhesive film, for example, and the technique of feeding a film during the use of a roll of the film.

DESCRIPTION OF RELATED ART

Generally, an anisotropic conductive adhesive film or an insulating adhesive film is used, for example, to electrically connect electronic components such as liquid crystal panels or IC chips to each other.

Such adhesive films are delivered to clients in the form of rolls obtained by winding a long continuous film prepared through certain preparation processes per a certain length around a reel member using a winding apparatus.

Recently, further longer adhesive films are desired from the client side.

However, longer adhesive films require reel members with larger diameters, which involve significant changes in design conditions of existing winding apparatus such as the arrangement of guide rollers and sensors around the reel members.

On the other hand, a feeding apparatus used to draw out adhesive films from reel members with larger diameters must also be significantly changed on the client side in the same manner as winding apparatus on the manufacturer side.

The present invention was made to solve these technical problems with the purpose of providing a winding apparatus and a feeding apparatus adaptable to longer films with minimum design changes in existing apparatus.

SUMMARY OF THE INVENTION

The present invention provides a winding apparatus comprising a winding shaft on which a reel member capable of winding a given film at multiple stages can be mounted and a driving mechanism for axially moving the winding shaft on which the reel member is mounted.

According to the winding apparatus of the present invention, the diameter of the flange can be maintained even when a long film is wound, whereby design changes in existing winding apparatus can be minimized.

The winding apparatus of the present invention advantageously comprises a marking mechanism for giving an identifiable marker on the film.

According to the present invention, not only the quality of the film can be maintained by avoiding the use of kinks in the film but also a marker for getting the timing of axial shift can be given when the film is fed on the client side.

The winding apparatus of the present invention also advantageously comprises a detection mechanism for detecting the position at which the marker is to be given and a controller for controlling the marking mechanism to operate on the basis of information from the detection mechanism.

According to the present invention, the film can be marked depending on the desired roll diameter of the film.

The present invention also provides a feeding apparatus comprising a feeding shaft on which a reel member wound with a given film at multiple stages can be mounted and which can be moved in the rotational and axial directions of the reel member, a driving mechanism for giving power in the rotational and axial directions to the feeding shaft, and a detection mechanism capable of detecting a given marker on the film.

According to the feeding apparatus of the present invention, a long film can be handled without increasing the diameter of the flange, thus minimizing design changes in existing feeding apparatus and also providing the advantage that a reel member wound with a film can be used for a long period without replacement.

The feeding apparatus of the present invention advantageously comprises a controller for controlling the driving mechanism to generate power at least in the axial direction on the basis of information from the detection mechanism.

According to the present invention, the film can be smoothly fed to axially move the reel member by detecting a marker on the film on the client side while unnecessary treatments of kinks can be avoided when the film is wound on the manufacturer side.

The present invention also provides a film for multistage winding formed of an adhesive film containing an adhesive applied on a release film wherein the release film is exposed at predetermined intervals.

According to the film for multistage winding of the present invention, the length of the release film alone is controlled to prevent the adhesive from sticking to the reel member and to limit kinks to the release film during passing over the reel member when the film is wound at multiple stages while the timing of feeding the film can be measured using exposed parts of the release film as markers when the film wound at multiple stages is fed.

The present invention also provides a method for feeding a continuous film from a roll of the film wound at multiple stages in the axial direction of a feeding shaft, comprising feeding the film of a given stage and then feeding the film of the next stage by axially moving the winding shaft.

According to the method for feeding a film of the present invention, the film can be smoothly fed from a roll of the film wound at multiple stages.

The present invention also provides a method for feeding a continuous film for multistage winding from a roll of the film wound at multiple stages, the film being formed of an adhesive film containing an adhesive applied on a release film wherein the release film is exposed at given intervals, the method comprising feeding the film of a given stage and then feeding the film of the next stage by axially moving the winding shaft on the basis of detected information of the exposed part of the release film.

According to the method for feeding a film of the present invention, the film can be smoothly drawn out from each stage of a roll of the film wound at multiple stages without causing kinks in the adhesive film.

In these drawings, various numeral references represent the following elements: 10, winding apparatus; 20, feeding apparatus; 21, feeding shaft; 31, winding shaft; 26, 40, driving mechanism; 22, 42, first driving mechanism; 24, 44, second driving mechanism; 42*d*, 42*e*, 29, detection mechanism; 50, reel member; 60, 60A, controller; 70, adhesive-stripping mechanism (marking mechanism).

DETAILED DESCRIPTION OF PREFERRED EMBODIMENTS

Winding apparatus of the present invention is used to wind a continuous long film at multiple stages.

Films used in the present invention are advantageously, but not limited to, insulating adhesive films or anisotropic conductive adhesive films, especially for electrically connecting electrodes of circuit boards to electrodes of IC chips.

Insulating adhesive films here comprise an insulating adhesive formed as a film on a release film. Anisotropic conductive adhesive films mean films comprising said adhesive containing conductive particles.

Preferred embodiments of reel members capable of winding such insulating adhesive films and anisotropic conductive adhesive films (hereinafter sometimes referred to as simply "films") are explained below with reference to the attached drawings.

In the films used in the following embodiments, the adhesive is removed at predetermined intervals to partially expose the release film.

A preferred embodiment of a winding apparatus of the present invention is explained in detail below with reference to the attached drawings.

Figure 1:
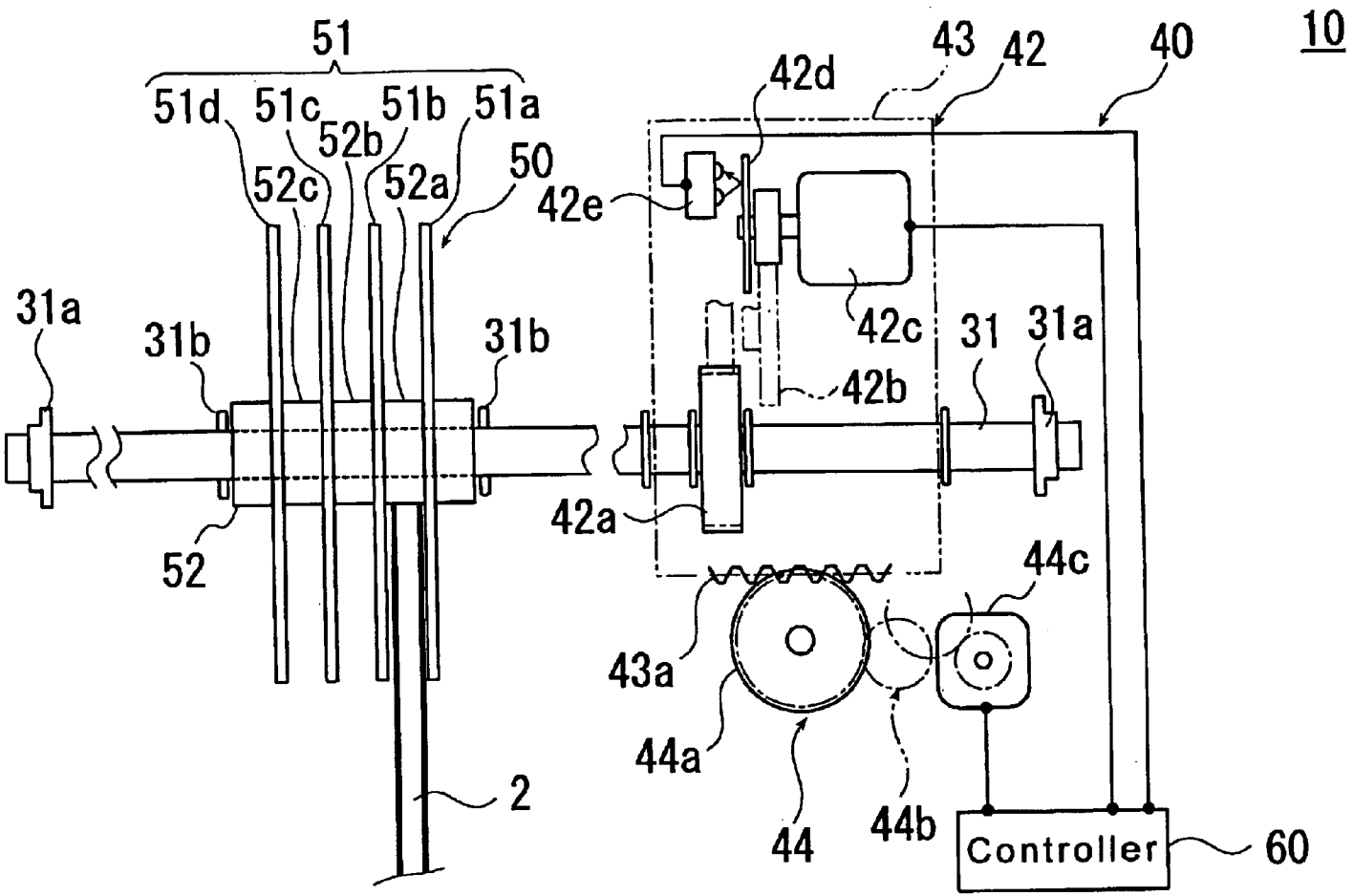
FIG. 1 is a front view showing the outline structure of a winding apparatus of the present invention.
Figure 2:
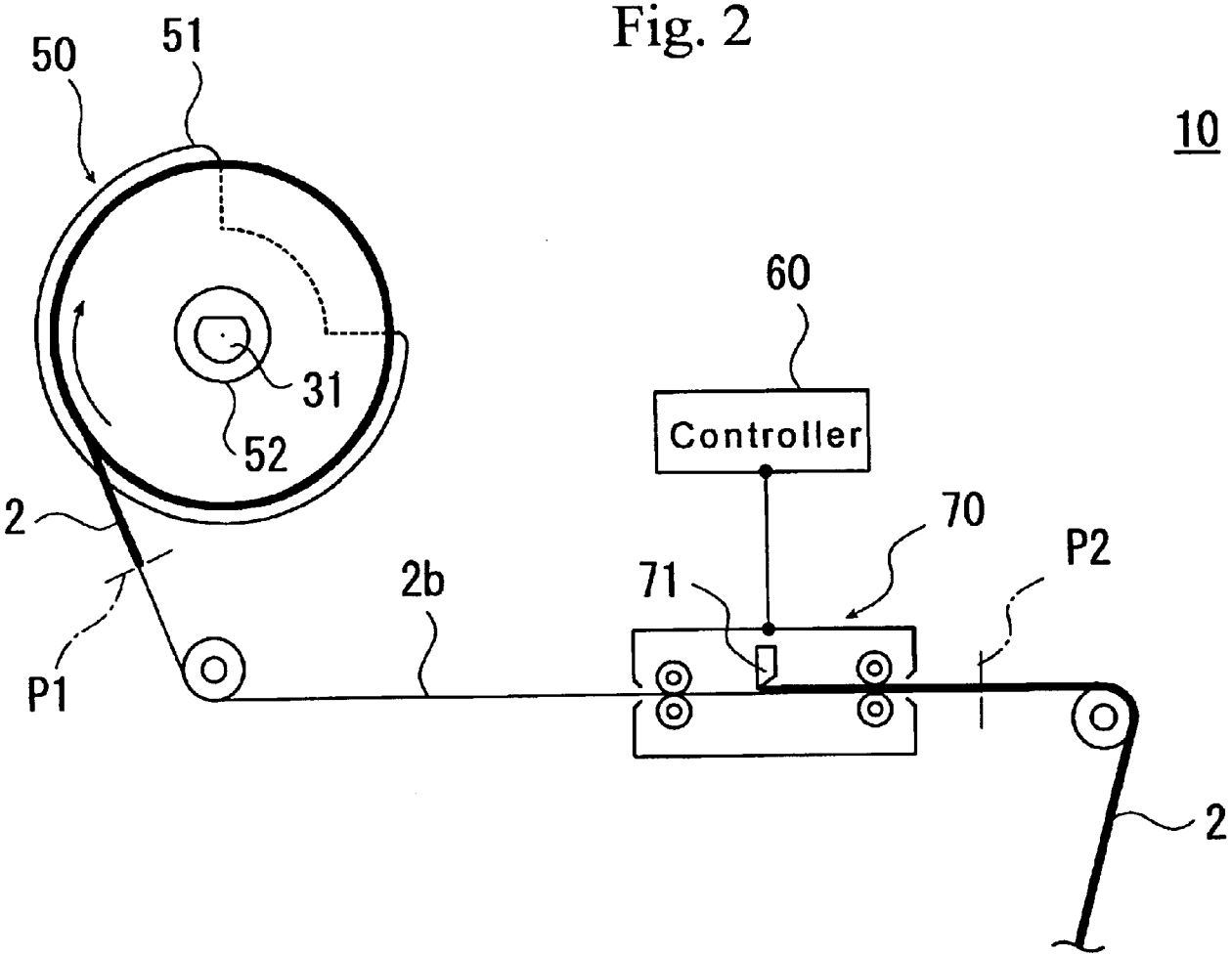
FIG. 2 is a left side view showing the outline structure of the winding apparatus.

FIG. 1 is a front view showing the outline structure of a winding apparatus of the present invention, and FIG. 2 is a left side view showing the outline structure of the winding apparatus.

As shown in FIG. 1 or FIG. 2, winding apparatus 10, according to the present embodiment, comprises a winding shaft 31, a driving mechanism 40 and a controller 60.

A winding shaft 31 is intended to be mounted on a given reel member described below and provided in parallel to a feeding shaft (not shown in drawings) on the feeding side of film 2. This winding shaft 31 is supported by bearing members 31*a* at both ends so that it can be moved in both radial and axial directions.

An example of the reel member that can be mounted on winding shaft 31 is shown below.

Figure 3A:
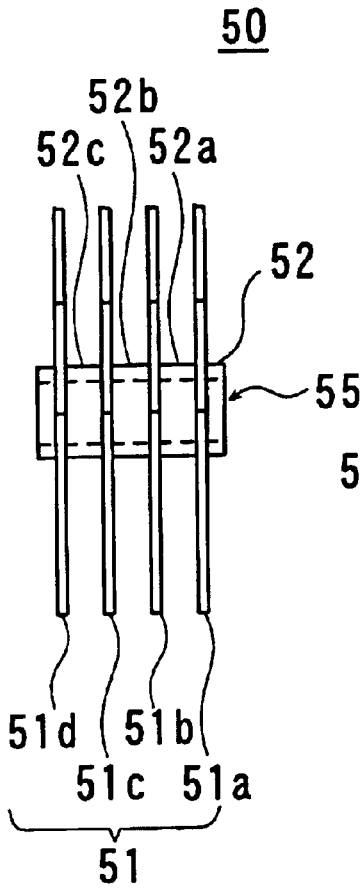
FIG. 3(*a*) is a front view showing the outline structure of an example of a reel member used in a winding apparatus of the present invention, and FIG. 3(*b*) is a right side view showing the outline structure of the reel member.
Figure 3B:
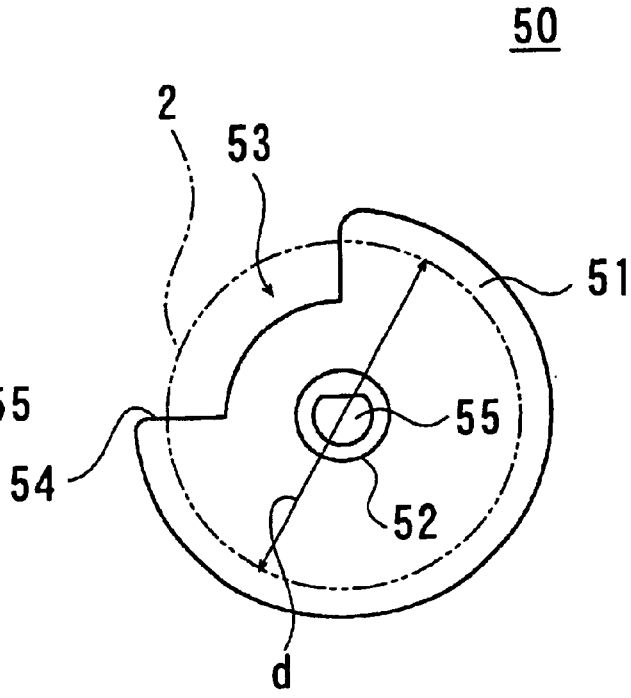

FIG. 3(*a*) is a front view showing the outline structure of an example of a reel member used in a winding apparatus of the present invention, and FIG. 3(*b*) is a right side view showing the outline structure of the reel member.

As shown in FIGS. 3(*a*) and (*b*), a reel member 50 used in the present embodiment is integrally formed from a resin, for example, and comprises a winding spool 52 and a plurality of flanges 51.

These flanges 51 are formed as discs having a predetermined outer diameter and arranged in parallel to each other at predetermined intervals on cylindrical winding spool 52.

The outer diameter of flange 51 is determined to be greater than the maximum roll diameter d of film 2 for the purpose of protecting a roll of film 2. The maximum roll diameter d here is selected depending on the length of film 2 so that the adhesive cannot be squeezed out of the end face of the roll under the stress generated during winding.

The number of flanges 51 is selected depending on the maximum roll diameter d and the length of the film to be contained in reel member 50, and the interval between flanges 51 is selected to be somewhat greater than the width of the film (e.g., 1.9 mm).

As shown in FIG. 3(*b*), each flange 51 has a guide groove 53 of the same shape for passing the film to another flange 51 adjacent thereto.

Guide grooves 53 are each cut away in an approximately sectorial shape to only partially expose the rolled film and are axially aligned in opposite to guide grooves 53 adjacent thereto.

Thus, a guide edge 54 formed on the outer periphery of each guide groove 53 comes into contact with the film at the same position as the other guide edges 54 in the circumferential direction of flange 51.

Winding spool 52 is formed in a length depending on the number of flanges 51 or the interval therebetween. Winding spool 52 has an axially running through-hole 55 having a cross section substantially in the form of a letter "D" .

As shown in FIG. 1, winding shaft 31 is designed to be fitted into through-hole 55 in reel member 50 with a slight gap, thereby supporting reel member 50 in such a manner that it can be axially moved while it is fixed against circumferential movement.

Reel member 50 is blocked from axial movement by a pair of pins 31*b* on winding shaft 31, whereby each winding spool 52 is positioned in relation to film 2 on the feeding side.

As shown in FIG. 1, driving mechanism 40 comprises a first driving mechanism 42 for giving power in the rotational direction to winding shaft 31, and a second driving mechanism 44 for giving power in the axial direction to winding shaft 31.

First driving mechanism 42 is designed to transmit the power of a winding motor 42*c*, consisting of a stepping motor, to a gear 42*a* fixed to winding shaft 31 via a given train of gears 42*b* to rotate winding shaft 31.

An encoder 42*d* having a plurality of slits is fixed to winding motor 42*c* as a detection mechanism and a light reflective sensor 42*e* capable of detecting encoder 42*d* is also provided.

Such winding motor 42*c* and sensor 42*e* are electrically connected to controller 60 respectively. Controller 60 is designed to count the number of pulses of winding motor 42*c* on the basis of signals from sensor 42*e* and to control the rotation of winding motor 42*c* on the basis of the number of pulses.

Second driving mechanism 44 is designed to transmit the power of a slide motor 44*c*, consisting of a stepping motor, to a gear 44*a* engaging with a rack 43*a*, provided at a part of a casing 43 containing first driving mechanism 42, via a given train of gears 44*b* to slide the rotational shaft 31 in cooperation with first driving mechanism 42 while casing 43 is fixed on winding shaft 31.

This slide motor 44*c* is electrically connected to controller 60 so that it is controlled to operate for a time corresponding to a given number of pulses.

As shown in FIG. 2, winding apparatus 10, according to the present embodiment, comprises an adhesive-stripping mechanism 70 as an example of a marking mechanism.

This adhesive-stripping mechanism 70 is provided between a first position P1 and a second position P2 on the transporting path of film 2, and is designed to strip the adhesive from film 2, transported from the feeding side with a scraper 71, and to feed release film 2*b* alone to the winding side.

Adhesive-stripping mechanism 70 is electrically connected to controller 60 so that it is controlled to operate in accordance with a predetermined sequence.

When film 2 should be divided, as described herein, the part bearing an adhesive is designated as "adhesive film 2*a*" while the part bearing no adhesive is designated as "release film 2*b*".

Figure 5A:
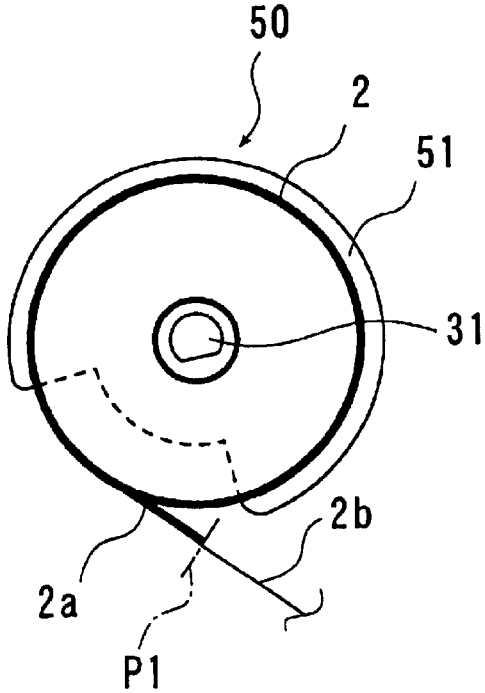
Figure 5B:
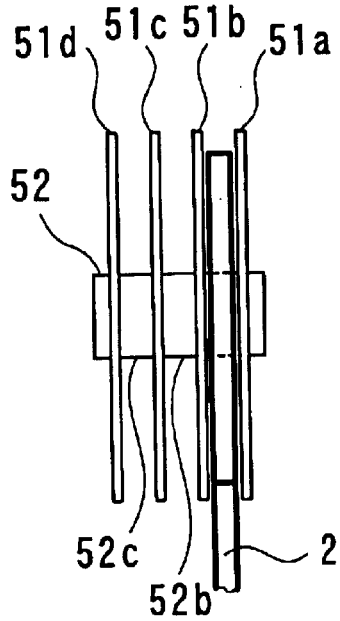

The first position P1, defined as the start position of release film 2*b* or the end position of adhesive film 2*a* (shown in FIG. 5(*a*), is determined depending on the maximum roll diameter d of reel member 50.

The distance between the first position P1 and the second position P2, i.e., the exposed length of release film 2*b*, is determined within a minimum range necessary for passing the film over flange 51 in order to prevent the adhesive from sticking to flange 51 and save the adhesive when the film is passed over reel member 50.

Release film 2*b* alone without adhesive on film 2 serves as a marker of a part having passed over reel member 50 in a feeding apparatus 20 described below.

The second position P2, defined as the end position of release film 2*b* or the start position of the next adhesive film 2*a*, is determined at a length that allows the second position P2 to be detected in feeding apparatus 20 at the stage when the first position P1 of release film 2*b* arrives on winding spool 52, around which adhesive film 2*a* has been wound in order to limit kinks to release film 2*b* when the film is passed over reel member 50.

How a film is wound according to the present embodiment having the structure described above is explained with reference to the attached drawings.

Figure 4A:
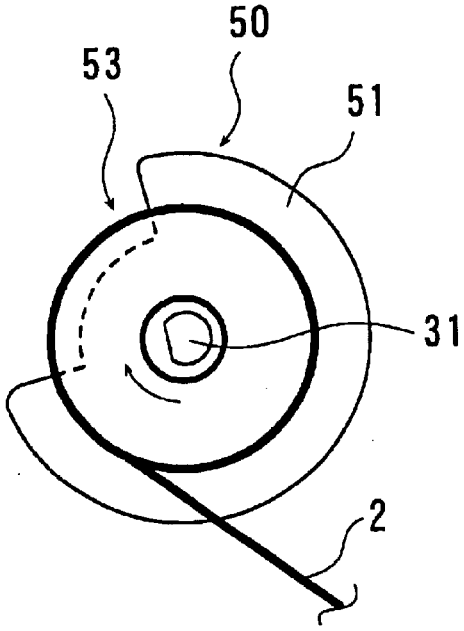
FIG. 4(*a*) to FIG. 9(*a*) are left side views showing how a film is wound around a reel member used in the present invention, and FIG. 4(*b*) to FIG. 9(*b*) are front views showing how the film is wound.
Figure 4B:
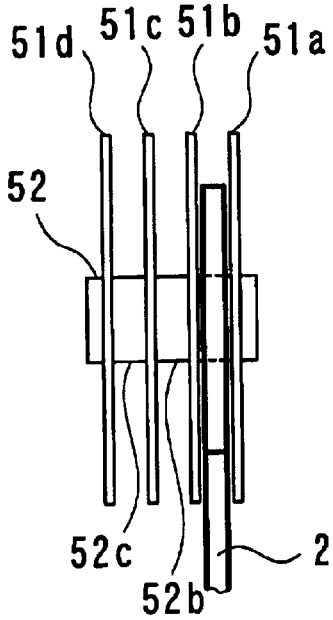
Figure 9A:
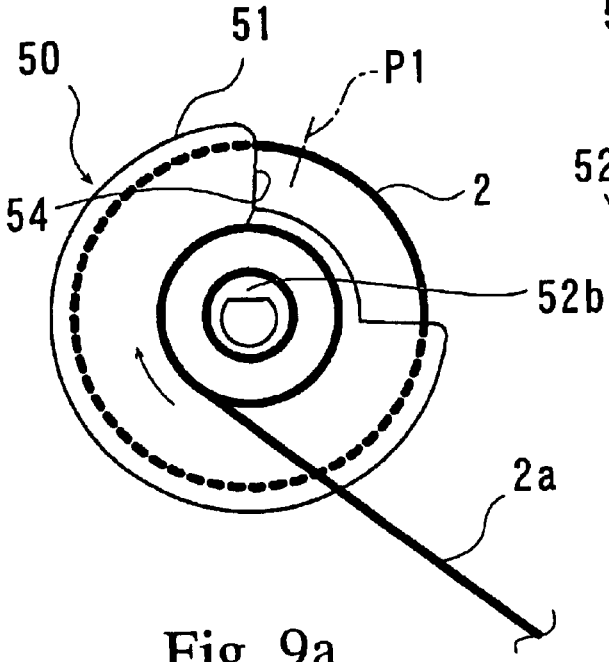
Figure 9B:
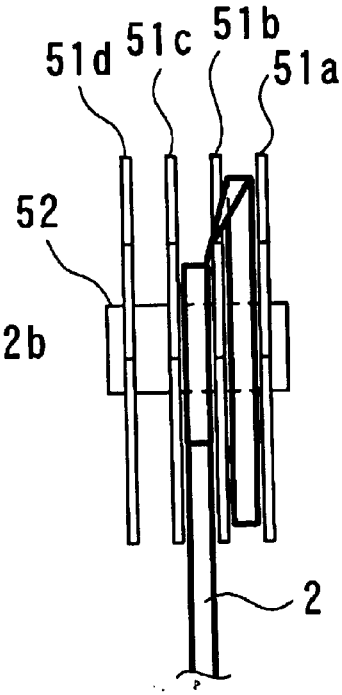

FIG. 4(*a*) to FIG. 9(*a*) are left side views showing how a film is wound around a reel member used in the present invention, and FIG. 4(*b*) to FIG. 9(*b*) are front views showing how the film is wound.

In the following description, flanges 51 of reel member 50 are designated as "first flange 51*a*", "second flange 51*b*", "third flange 51*c*" and "fourth flange 51*d*" successively from the rightmost one, and winding spools 52 of reel member 50 are designated as "first winding spool 52*a*" between first and second flanges 51*a* and 51*b*, "second winding spool 52*b*" between second and third flanges 51*b* and 51*c*, and "third winding spool 52*c*" between third and fourth flanges 51*c* and 51*d*, as shown in FIG. 1.

In the present embodiment, reel member 50 is first mounted on winding shaft 31 and positioned in such a manner that film 2 on the feeding side is evenly supported between first and second flanges 51*a* and 51*b*, as shown in FIGS. 4(*a*) and (*b*).

Then, the leading end of film 2 on the feeding side is manually wound around first winding spool 52*a* of reel member 50 on the winding side.

Under a command from controller 60 described above, winding motor 42C is activated to start the rotation of winding shaft 31 and also start to count the number of pulses of winding motor 42C.

Thus, film 2 is wound around first winding spool 52*a* while it is being drawn from the feeding side by reel member 50 (see FIGS. 4(*a*), (*b*)).

Controller 60 generates a command to activate adhesive-stripping mechanism 70 when it judges from the number of pulses of winding motor 42*c* that the diameter of film 2 wound around first winding spool 52*a* reaches the maximum roll diameter d (see FIG. 2). Thus, adhesive-stripping mechanism 70 strips the adhesive from film 2, along a predetermined length, from the first position P1 to the second position P2.

When controller 60 judges from the number of pulses of winding motor 42*c* that the leading end (first position P1) of release film 2*b* is on the position of passing through guide groove 53 in second flange 51*b* while first winding spool 52*a* of reel member 50 is finishing to wind the part of adhesive film 2*a* as shown in FIGS. 5(*a*) and (*b*), it stops the operation of winding motor 42*c*.

Figure 6A:
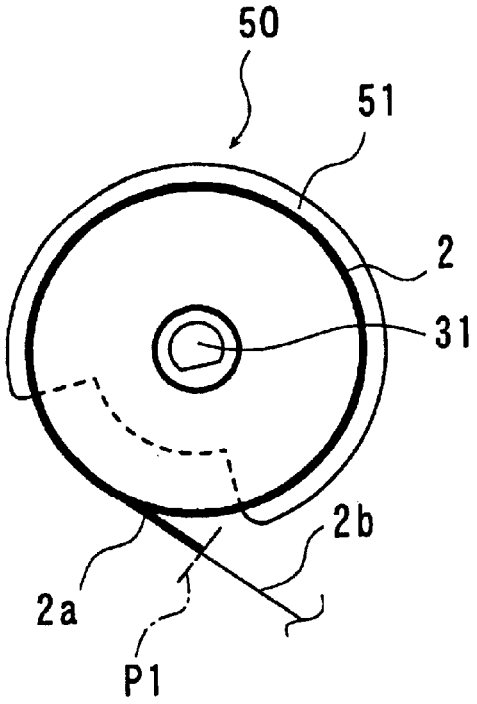
Figure 6B:
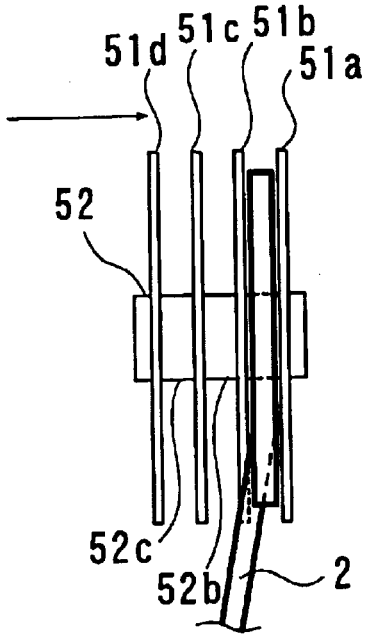

At this point, slide motor 44*c* is operated for a time corresponding to a given number of pulses to axially (in the direction of arrow in FIG. 6(*b*)) slide winding shaft 31, as shown in FIGS. 6(*a*) and (*b*), under a command from controller 60. Thus, reel member 50 moves with winding shaft 31 so that release film 2*b* on the feeding side comes to a twisted position with respect to film 2 on first winding spool 52*a*. Release film 2*b* runs off guide groove 53 of second flange 51*b* to approach third flange 51*c*.

Figure 7A:
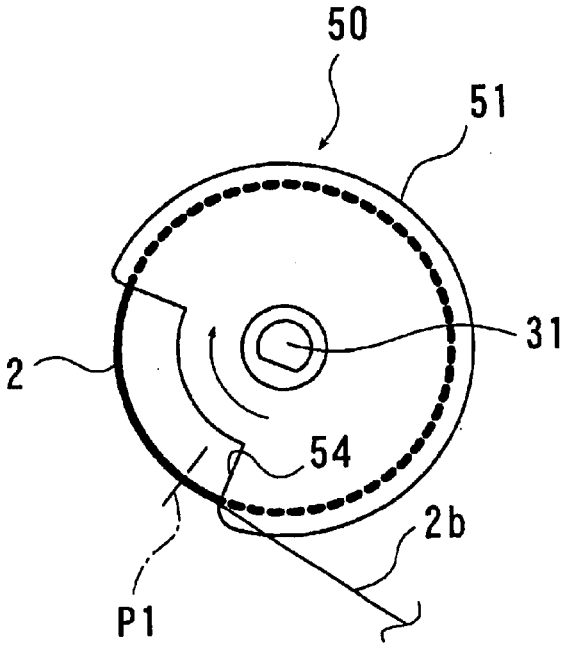
Figure 7B:
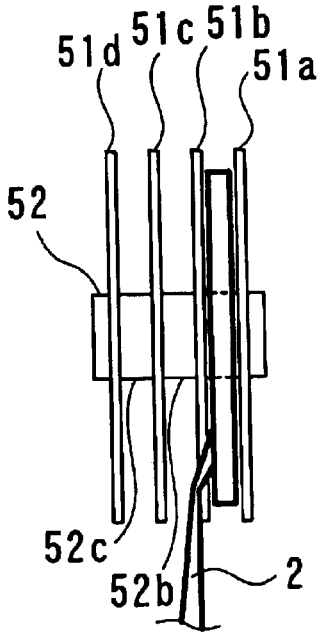

When reel member 50 is rotated again in this state, second flange 51*b* catches release film 2*b* at guide edge 54, as shown in FIGS. 7(*a*) and (*b*).

Figure 8A:
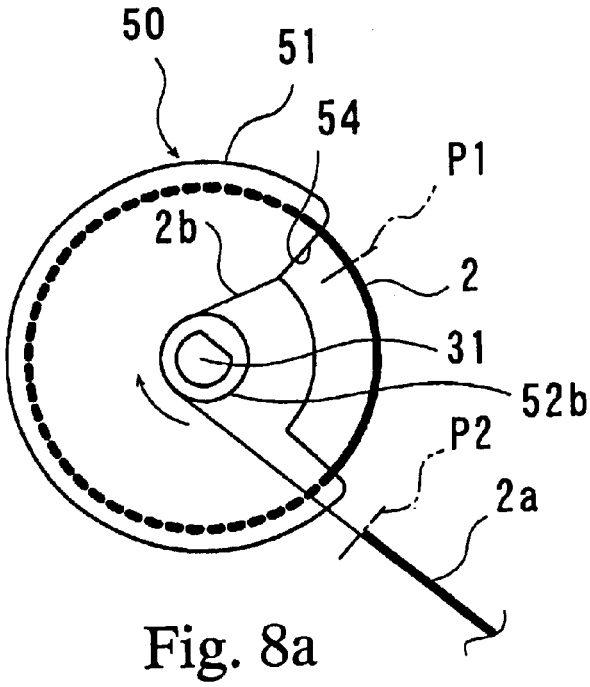
Figure 8B:
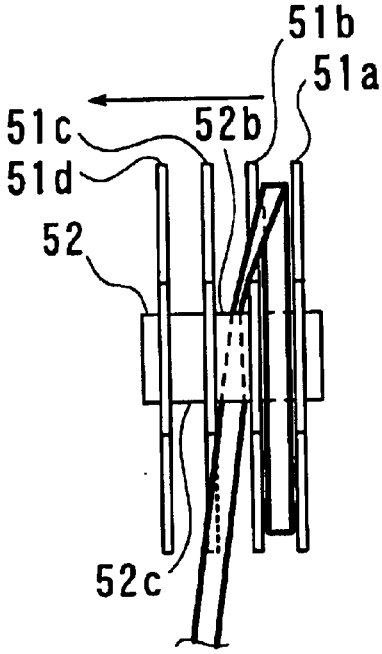

As reel member 50 rotates, it then winds release film 2*b* around second winding spool 52*b* while it is caught by second flange 51*b*, and it further rotates to wind adhesive film 2*a* upstream of the rear end (second position P2) of release film 2*b*, as shown in FIG. 8.

On the other hand, slide motor 44*c* is operated under a command from controller 60 so that reel member 50 is moved in the direction of the arrow in FIG. 8(*b*) and returned to the position in which film 2 on the feeding side is evenly supported between second and third flanges 51*b* and 51*c*, as shown in FIG. 8(*b*) and FIG. 9(*b*).

Then, the winding operation as described above is repeated for third winding spool 52*c* of reel member 50.

Figure 10A:
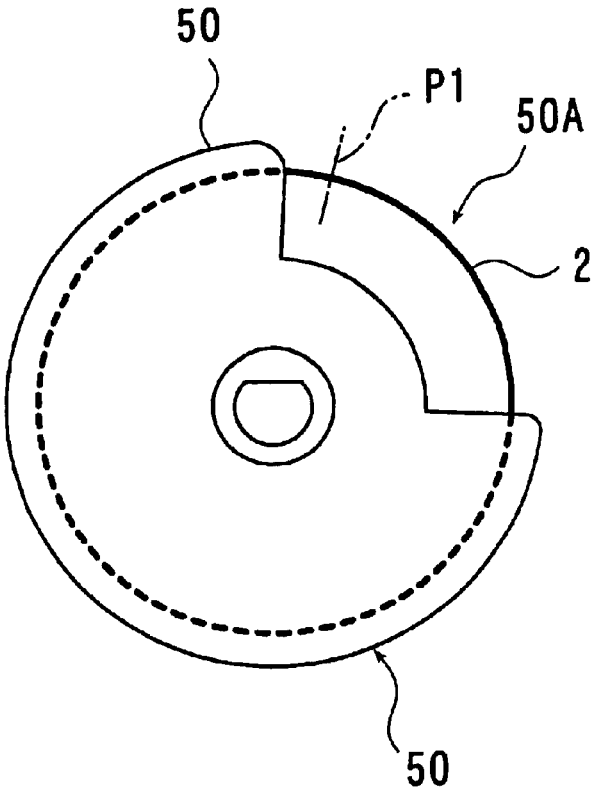
FIG. 10(*a*) is a left side view showing a reel member used in the present invention around which a film has been wound, and FIG. 10(*b*) is a front view showing the reel member around which a film has been wound.
Figure 10B:
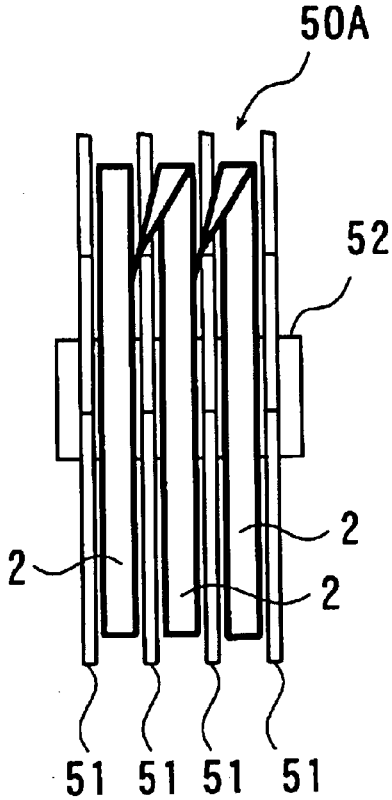

FIG. 10(*a*) is a left side view showing a reel member used in the present invention around which a film has been wound, and FIG. 10(*b*) is a front view showing the reel member around which a film has been wound.

A film package 50A is obtained in which adhesive film 2*a* is wound around each winding spool 52 successively from first winding spool 52*a* to third winding spool 52*c* with exposed parts of release film 2*b* being passed from flanges 51 to winding spools 52, as shown in FIGS. 10(*a*) and (*b*), by applying the winding operation described above.

Next, a preferred embodiment of a feeding apparatus according to the present invention is explained below referring to an affixing system as an example.

Figure 11:
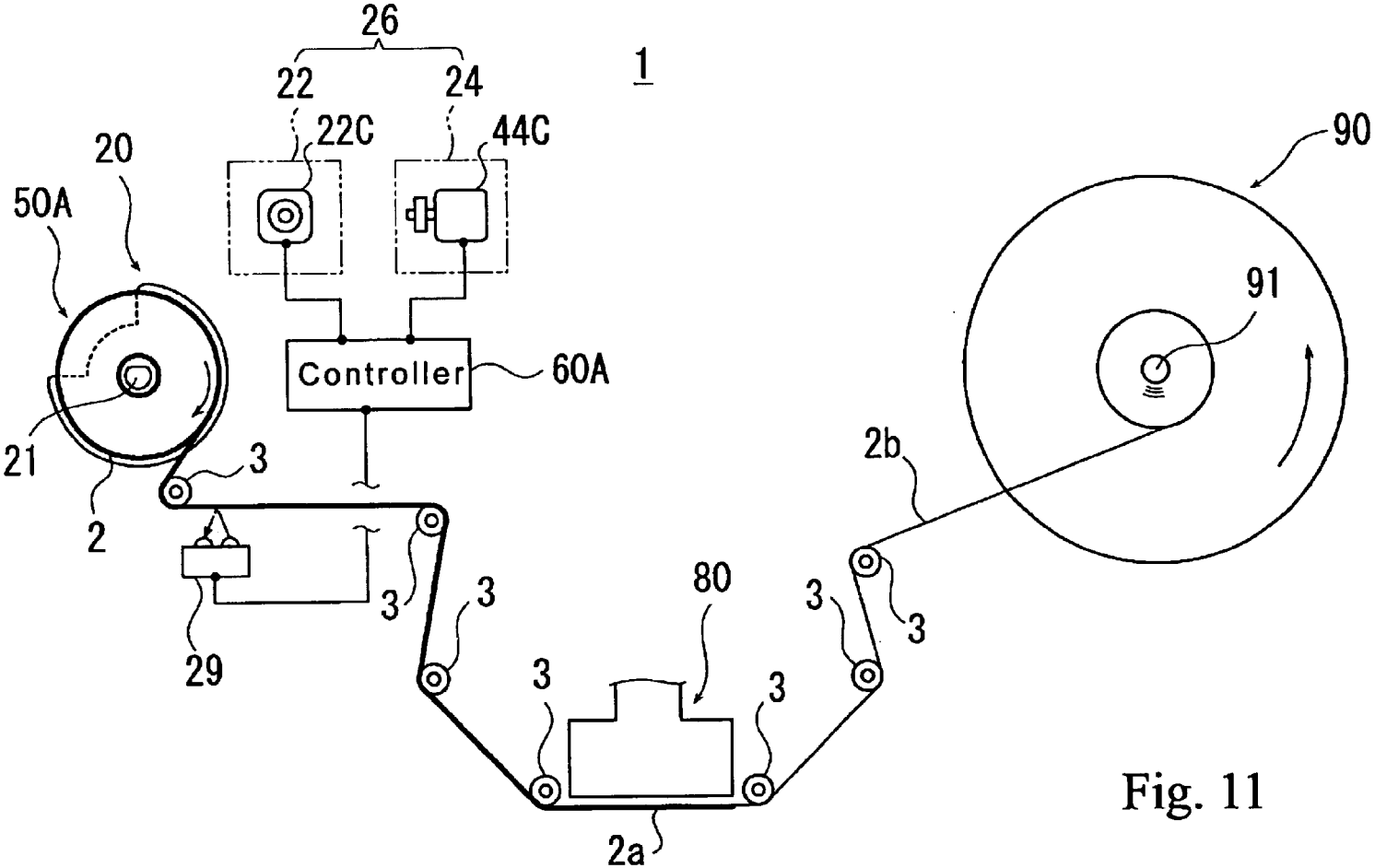
FIG. 11 is a left side view showing the outline structure of an affixing system incorporating a feeding apparatus of the present invention.

FIG. 11 is a left side view showing the outline structure of an affixing system incorporating a feeding apparatus of the present invention.

As shown in FIG. 11, the affixing system 1, according to the present embodiment, is intended to affix adhesive film 2*a* at a given position on, for example, a circuit board, and comprises a feeding apparatus 20, a pressure head 80 and a winding mechanism 90.

Feeding apparatus 20 comprises a feeding shaft 21, a driving mechanism 26 consisting of a first and a second driving mechanisms 22, 24 and a controller 60A, and is designed to feed a continuous film 2 from film package 50A approximately in the same manner as winding apparatus 10 described above.

In the case of the present embodiment, feeding apparatus 20 comprises a film sensor (detection mechanism) 29 in the structure.

This film sensor 29 is a light reflective sensor located in the proximity of feeding apparatus 20 where the adhesive side of film 2 can be detected. Film sensor 29 is electrically connected to controller 60A. This controller 60A is designed to control the power of feeding motor 22*c* and slide motor 44*c* contained in first and second driving mechanisms 22, 24, respectively, on the basis of signals from film sensor 29.

Pressure head 80 is designed to apply heat and pressure to film 2 transported on a given path via guide rollers 3 from feeding apparatus 20. This pressure head 80 is electrically connected to controller 60A, whereby the operation of pressure head 80 itself is controlled by a driving mechanism not shown on the basis of signals from film sensor 29.

Winding mechanism 90 is designed to give a rotating power to the spool around which film 2 is to be wound.

How a film is fed in the present embodiment having such a structure is explained with reference to the attached drawings.

Figure 12B:
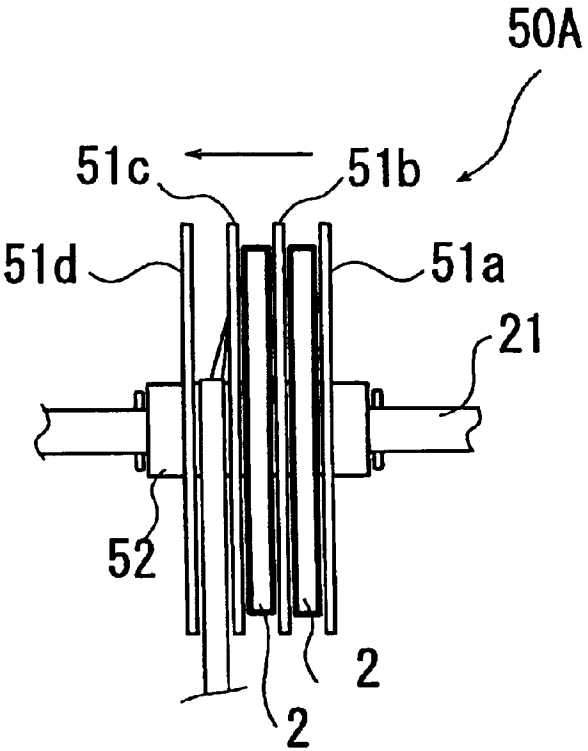
FIG. 12(*a*) is a left side view showing how a film is fed from a reel package used in the present invention, and FIG. 12(*b*) is a front view showing how a film is fed from the reel package.
Figure 12A:
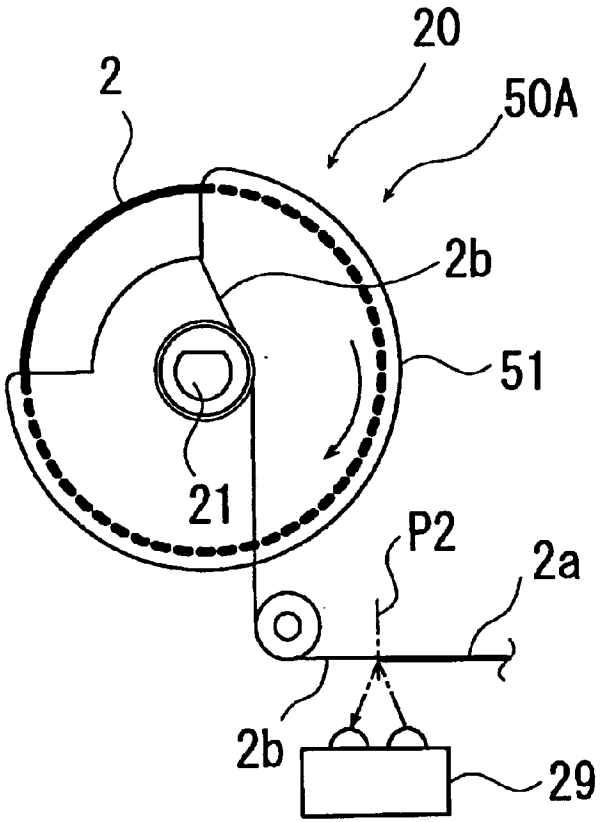

FIG. 12(*a*) is a left side view showing how a film is fed from a reel package used in the present invention, and FIG. 12(*b*) is a front view showing how a film is fed from the reel package.

In the case of the present embodiment, the behavior of film 2, fed from reel package 50A by feeding apparatus 20, is reverse to that of film 2 wound by winding apparatus 10, i.e. film 2 is first fed on a path including pressure head 80 from third winding spool 52*c* of reel package 50A as feeding shaft 21 rotates.

When film sensor 29 detects the leading end (second position P2) of release film 2*b*, bounded by adhesive film 2*a*, after third winding spool 52*c* (see FIG. 8(*b*)) of reel package 50A has completed feeding of adhesive film 2*a*, as shown in FIGS. 12(*a*), (*b*), controller 60A commands feeding motor 22*c* to stop at such a timing that release film 2*b* passes through guide groove 53 of third flange 51*c* on the basis of signals from film sensor 29, and then activates slide motor 44*c* to slide feeding shaft 21 in the direction of the arrow shown in FIG. 12(*b*).

In this case, the rear end (first position P1) of release film 2*b* is situated on adhesive film 2*a* in the roll so that film 2, drawn out by sliding reel package 50A, is exposed release film 2*b* and no kinks occur in adhesive film 2*a* during such drawing out.

Then, feeding shaft 21 is rotated again to feed film 2 on the path including pressure head 80 from second winding spool 52*b* of reel package 50A. Subsequently, the operation described above is repeated to transfer film 2 from second winding spool 52*b* to first winding spool 52*a*.

Thus, adhesive film 2*a* fed from feeding apparatus 20 is affixed under pressure by operating pressure head 80 at a given timing as shown in FIG. 11, and at the same time, release film 2*b* is sequentially wound by winding mechanism 90.

According to the present embodiment as described above, reel member 50 (including reel package 50A) is mounted and rotated and axially moved at the same time so that a continuous film 2 can be wound at multiple stages, or a film 2 can be continuously fed from a multistage roll of film 2, whereby a long film 2 can be handled without increasing the diameter of flange 51, and accordingly, design changes in existing winding apparatus or feeding apparatus can be minimized.

Especially, feeding apparatus 20 has the advantage that reel member 50 containing film 2 can be used for a long period without replacement.

According to the present embodiment, the adhesive is stripped from regions of film 2 necessary to be passed over flanges 51 to differentiate these regions from adhesive regions so that not only the quality of film 2 can be maintained by avoiding the use of kinks on the client side when film 2 is wound, but also markers for getting the timing of axial shift can be given when film 2 is fed on the client side.

Moreover, the length of release film 2*b* is determined depending on the necessary length to be passed over reel member 50, thereby preventing the adhesive on film 2 from sticking to flanges 51.

On the client side, regions formed of release film 2*b* alone are detected as markers (second position P2) so that film 2 can be smoothly fed and unnecessary treatments of the non-adhesive regions can be avoided.

The present invention is not limited to the foregoing embodiments, but may include various modifications.

For example, adhesive-stripping mechanism 70 used for stripping the adhesive at predetermined intervals in the foregoing embodiment will be unnecessary in the present invention if a film comparable to those treated in adhesive-stripping mechanism 70 is prepared without forming an adhesive on release film 2*b*, at a timing similar to the timing used in adhesive-stripping mechanism 70, in the step of forming an adhesive on release film 2*b*, or if the step of partially forming non-adhesive regions and the winding step of the present invention are simultaneously performed.

In the present invention, a film for multistage winding formed by joining adhesive films 2*a*, each having a length corresponding to a roll with, e.g., a soft material, can also be used. In this case, the soft material serves as a marker at junctions to adhesive films (first and second positions) and a material softer than release film 2*b* is advantageously selected for passing the film.

The marking mechanism of the present invention is not limited to adhesive-stripping mechanism 70 according to the above embodiment, but other mechanisms capable of giving markers identifiable by known detection techniques such as printing mechanisms or punching machines can also be applied. Then, a detection mechanism can be provided on the side of feeding apparatus 20 depending on the markers given by the marking mechanism.

In this case, markers are periodically or continuously given so that the part of film 2 having been passed can be identified on the side of feeding apparatus 20 in the same manner as in the above embodiment, and at least the leading end of the part of film 2 having been passed (second position in the above embodiment) should be marked when such a part is fed.

The present invention is not limited to the embodiment in which feeding apparatus 20 of the present invention is incorporated into an affixing system 1, as shown above, but it may also be applied to a system in which a continuous film 2 must be continuously fed.

Reel member 50 in the embodiment above is shown only as an example, but the reel member used in winding apparatus 10 or feeding apparatus 20 of the present invention is not specifically limited so far as it satisfies such a condition that it can be mounted to both apparatus and can pass a film to an adjacent winding spool 52 with a flange 51 interposed therebetween.

A structure in which such reel member 50 and winding shaft 31 according to the above embodiment are combined can also be used, in which case the reel member combined with winding shaft 31 should be detachable from winding apparatus 10 and subjected to power in the rotational and axial directions when it is mounted on winding apparatus 10. This also applies to feeding apparatus 20.

Although winding shaft 31 itself moves in the rotational and axial directions while reel member 50 is fixed to winding shaft 31 in the above embodiment, the present invention can also include a structure wherein winding shaft 31 is rotated and reel member 50 is slid on winding shaft 31 while reel member 50 is supported on winding shaft 31 movably only in the axial direction.

Although driving mechanism 26 of feeding apparatus 20 is designed to give power to feeding shaft 21 in both rotational and axial directions using a motor in the above embodiment, a resilient member such as a spring may be used to apply a tension on film 2 from the side of winding mechanism 90 because power in the rotational direction is given from the side of winding mechanism 90.

In this case, however, independent power should preferably be given from separate motors in both rotational and axial directions of feeding shaft 21, as in the above embodiment, because the behavior of film 2 may be slowed down even if the power on the side of winding mechanism 90 is controlled as in the above embodiment and the tension generated in film 2 on pressure head 80 may be unstable.

As described above, the present invention provides winding apparatus and feeding apparatus adaptable to long films with minimum design changes in existing apparatus.

What is claimed is:

1. A winding apparatus comprising:

a winding shaft on which a reel member capable of winding a film for multistage winding at multiple stages can be mounted, and the film being formed of an adhesive film containing an adhesive applied on a release film wherein the release film is exposed at given intervals, and a driving mechanism for axially moving the winding shaft on which the reel member is mounted, wherein the winding shaft is axially moved depending on the position of the exposed part of the release film in relation to the reel member when the film for multistage winding is wound.

2. The winding apparatus of claim 1 comprising adhesive-stripping mechanism for acting on the adhesive film containing the adhesive applied on a release film to expose the release film at given intervals.

3. The winding apparatus of claim 2 comprising a detection mechanism for detecting the position at which the release film is to be exposed and a controller for controlling the adhesive-stripping mechanism to operate on the basis of information from the detection mechanism.

4. A feeding apparatus comprising:

a feeding shaft on which a reel member wound with a film for multistage winding at multiple stages can be mounted and which can be moved in rotational and axial directions of the reel member, the film being formed of an adhesive film containing an adhesive applied on a release film wherein the release film is exposed at given intervals, a driving mechanism for giving power in the rotational and axial directions to the feeding shaft, a detection mechanism capable of detecting the position of the exposed part of the release film in the film for multistage winding, and a controller for controlling the driving mechanism to generate power at least in the axial direction on the basis of information from the detection mechanism.

5. A method for feeding a continuous film for multistage winding from a roll of the film wound at multiple stages, the film being formed of an adhesive film including an adhesive applied on a release film wherein the release film is exposed at given intervals, the method comprising the steps of:

feeding a given state of the film; and then feeding next stage of the film by axially moving a winding shaft on the basis of detected information of the exposed part of the release film.

* * * * *